US006748837B2

(12) United States Patent
Benjamin et al.

(10) Patent No.: US 6,748,837 B2
(45) Date of Patent: Jun. 15, 2004

(54) APPARATUS FOR SIZING AND HALVING FOOD PRODUCT

(75) Inventors: Scott R. Benjamin, Terrebone, OR (US); John E. Mobley, Bend, OR (US); Marc R. Olsen, Bend, OR (US)

(73) Assignee: Key Technology, Inc., Walla Walla, WA (US)

( * ) Notice: Subject to any disclaimer, the term of this patent is extended or adjusted under 35 U.S.C. 154(b) by 0 days.

(21) Appl. No.: 10/120,457

(22) Filed: Apr. 10, 2002

(65) Prior Publication Data

US 2002/0166431 A1 Nov. 14, 2002

Related U.S. Application Data

(63) Continuation-in-part of application No. 09/484,904, filed on Jan. 18, 2000, now abandoned.

(51) Int. Cl.[7] ..... B26D 7/06

(52) U.S. Cl. ..... 83/435.2; 83/446; 83/449; 83/932

(58) Field of Search ..... 83/932, 449, 446, 83/423, 435.2, 271, 435; 198/458, 836.3, 636

(56) References Cited

U.S. PATENT DOCUMENTS 1,489,061 A 4/1924 Burdick
1,777,384 A 10/1930 Smith
1,961,009 A 5/1934 Nachtigal
2,211,433 A * 8/1940 Papendick ..... 83/105
2,439,657 A 4/1948 Hexter et al.
2,800,939 A 7/1957 Vance
3,133,573 A 5/1964 Cummings
3,168,950 A 2/1965 Niederer et al.
3,491,807 A * 1/1970 Underwood ..... 83/105
3,527,333 A * 9/1970 Standley ..... 198/458
4,005,625 A 2/1977 Brochu et al.
4,259,886 A 4/1981 Seid et al.
5,238,121 A 8/1993 Frisbie
5,335,571 A 8/1994 Pike

* cited by examiner

*Primary Examiner*—Kenneth E. Peterson
(74) *Attorney, Agent, or Firm*—Chernoff, Vilhauer, McClung & Stenzel, LLP

(57) ABSTRACT

An apparatus for halving pieces of product includes a loading conveyor for conveying individual pieces of product and having a planar surface defining a plane tilted with respect to the horizontal and a lift conveyor comprising a moving surface positioned adjacent to the loading conveyor and oriented in a plane parallel to the axis of the loading conveyor for receiving pieces of product from the loading conveyor and for conveying them in an upward direction substantially at a right angle to the plane of the loading conveyor. The lift conveyor has a plurality of flites spaced along the lift conveyor, each flite supporting, one at a time, the pieces of product. A cutting blade is positioned to engage each piece of product as it moves along the lift conveyor so as to cut each piece of product into two pieces.

4 Claims, 10 Drawing Sheets

APPARATUS FOR SIZING AND HALVING FOOD PRODUCT

This application is a continuation in part of application Ser. No. 09/484,904 filed Jan. 18, 2000 now abandoned. The following invention relates to a machine for processing food product and more particularly relates to an apparatus for sizing and halving potatoes.

BACKGROUND OF THE INVENTION

In the food processing industry, the size of processed food product must be strictly maintained to meet the requirements of end users. For example, potato processors who deliver cut potatoes for use as french fries must take care to ensure that the cut potatoes are of proper length. Fast food outlets offer french fries to consumers in small pockets, bags or sleeves. The french-fried potatoes must be of the proper length in order to fit within the pockets. If the potatoes are too long, they cannot be contained in the company's standard packaging. What this means for the food processor is that cut raw potatoes for use as french fries will be rejected if a significant number of those potato slices fail to fall within length guidelines. It is therefore critically important for the food processor to ensure that the cut potato products delivered to the user meet the user's specifications for length.

Unfortunately, food product such as potatoes does not exist in uniform lengths. Grown potatoes can vary in length from three inches to eight inches or more. Food processors must therefor have a method of sorting potatoes so that the processed food product falls within specifications for length.

In the past, food processors have used sizing machines for sizing potatoes, grouping them into several different size categories prior to slicing. These products have generally been adequate for bulk processors such as those who sell to grocery stores, but since a high degree of size accuracy is not required for these uses, such machinery has been inadequate for processors who wish to sell to fast food chains.

BRIEF SUMMARY OF THE INVENTION

The machine of the invention provides an apparatus for sizing and halving food product. The apparatus contemplates that potatoes that fall within acceptable ranges are sorted according to size and product that exceeds acceptable ranges is cut in half so that the potato slices generated from halves of an oversized potato fall within acceptable requirements for length.

A combination sizing machine and product halver includes a first conveyor for carrying food product, canted at an angle, and a vertical lift conveyor having lanes of sized pockets of varying sizes for sorting food product that rolls from the first conveyor onto the lift conveyor. Following the product sizer, a product halver contains a second conveyor also canted to the horizontal plane and placed at the output of the first conveyor. In the halver, a second upwardly extending lift conveyor is oriented substantially perpendicular to the second conveyor belt. The second lift conveyor has pairs of product holders or flites which are positioned in side by side relation with a space between each pair of flites and placed along the lift conveyor at predetermined intervals. A cutting blade is positioned to extend into the space between the flites and to slice the oversized food product in half.

The halving mechanism also includes a centering device positioned above the conveyor belt for centering the food product so that it rests substantially in equal portions on the pairs of the flites. The centering mechanism includes pairs of centering heads at the ends of articulated arms which clamp either end of the food product. The arms are centered on the flite pairs so that when the clamp is applied the food product rests in equal portions between each side of the flites. A timer controls the actuation of the centering mechanism to center the product on the flites.

The lift conveyor for the sizing apparatus includes pockets that are formed by a series of flites with support rails and pairs of dividers. The dividers are adjustable along the support rails to define pockets of differing widths. The support rails include spaced slots and the dividers are slidable along the support rails with detent mechanisms which interact with the slots to affix the dividers to the support rails at positions chosen by the user.

In another aspect of the invention, an apparatus for halving pieces of product comprises a loading conveyor for conveying individual pieces of product in a direction along a longitudinal axis. A lift conveyor positioned adjacent to the loading conveyor and oriented at substantially a right angle thereto receives pieces of product from the loading conveyor and conveys pieces of product in an upward direction. The lift conveyor includes a plurality of flites spaced along the lift conveyor, each flite supporting, one at a time, the pieces of product. Centering fingers positioned adjacent to the lift conveyor engage the pieces of product as they are conveyed upward by the lift conveyor and center each piece of product on its respective flite, while a cutting blade is positioned to engage and cut each piece of product as it rises on the lift conveyor.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 5:
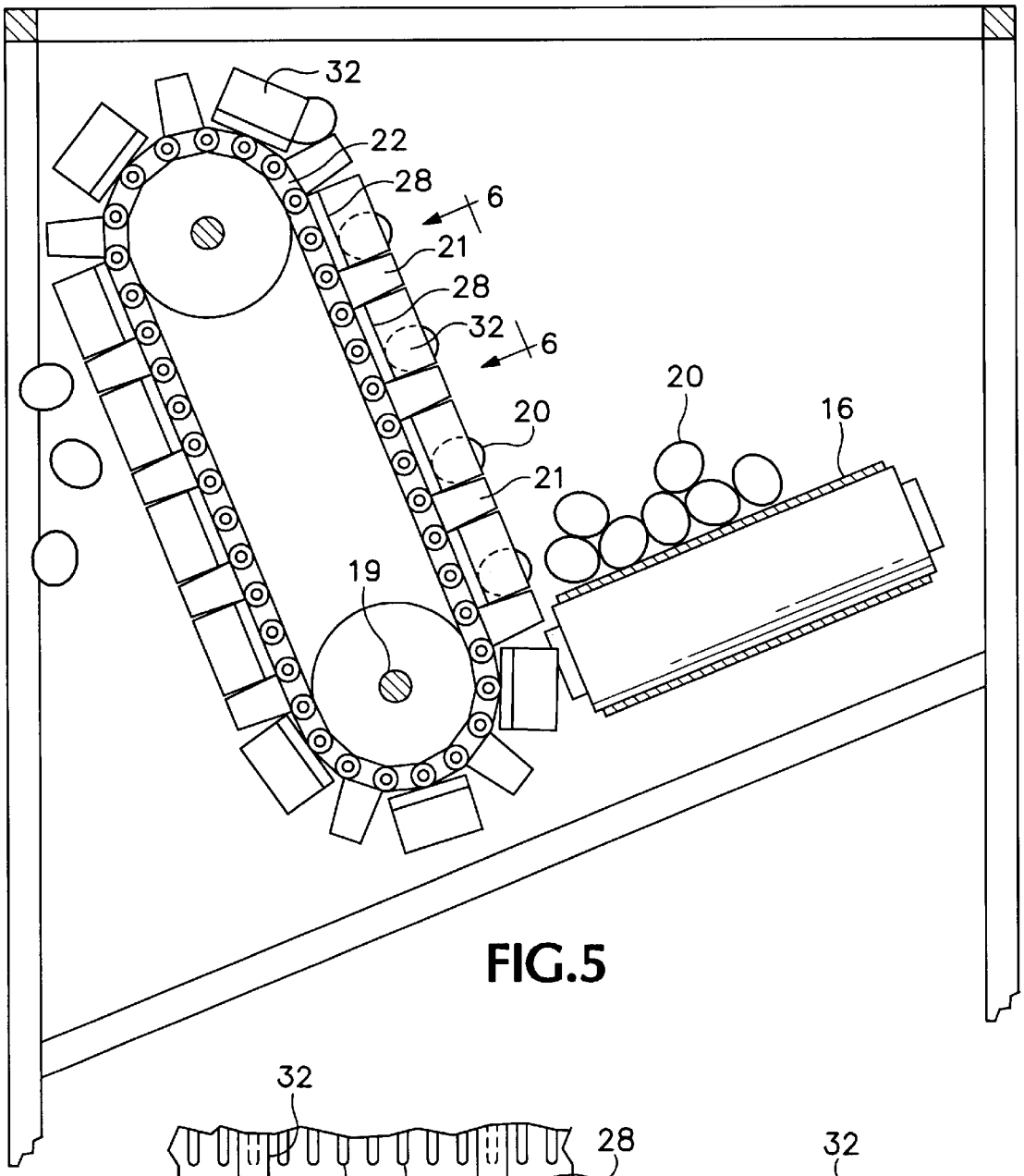
FIG. 5 is a cutaway end view taken along line 5—5 of FIG. 4.

Referring to FIGS. 1–4, a combined product sizing apparatus and product halving apparatus 10 includes a product sizer 12 supported on a frame 11 and a product halver 14 supported on a frame 13. The product sizer 12 includes a conveyor 16 of the endless belt type that is powered by a motor 18. Other types of conveyors could be used for this purpose, the endless belt type being merely the preferred type of conveyor for this application. As best shown in FIG. 5, the conveyor 16 is tilted in the horizontal plane so that product such as potatoes 20 is inclined to roll to the downwardly inclined side. Properly sized product is picked up by a vertical conveyor 22. The vertical conveyor 22 is another endless belt type of mechanism oriented upright in the vertical plane and which is driven by a motor 24. The vertical conveyor 22 is tilted with respect to the vertical plane in such a way that it is oriented substantially at a right angle to the plane of the conveyor 16. The preferred angle of tilt of the vertical conveyor is 67½° to the vertical, although any angle in a range of 65°–70° will work well. The vertical conveyor 22 also has a plurality of vertical lanes, 22*a*, 22*b*, etc., which are defined by horizontal bars or flites 21 and by dividers 32 whose positions are selected for sizing various pieces of food product as will be explained below.

As the food product 20 is conveyed by the conveyor belt 16, it will tend to roll to the side and be picked up by the vertical conveyor 22. The various lanes of the vertical conveyor 22 such as lanes 22*a* and 22*b* are sized so that smaller pieces of food product are allowed to fall onto pockets formed in the vertical conveyor 22 and as the pieces of food product progress in the direction of the motion of the conveyor belt 16, larger and larger product is accepted by downstream lanes of the conveyor 22 due to an increase in the spacing of the dividers 32 defining the lanes.

Figure 6:
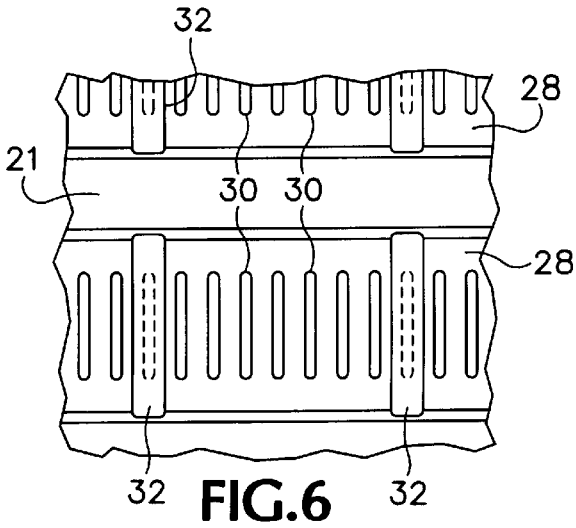
FIG. 6 is a partial front view of the vertical conveyor belt of FIG. 5 taken along line 6—6 of FIG. 5.
Figure 7:
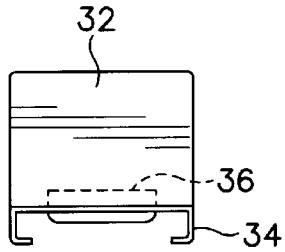
FIG. 7 is a front view of an adjustable divider adapted to be slidably mounted on the rail of FIG. 6.

Referring to FIGS. 5 and 6, the vertical conveyor 22 is formed of a plurality of articulated rail members 28 support flites 21, and dividers 32. The rail members 28 have shallow slots 30. Referring also to FIGS. 6 and 7, each of the dividers 32 are rectangular pieces that fit onto the rails 28 by virtue of a clip 34. Each of the dividers 32 has a spring loaded tab 36 that engages any one of the slots 30 depending upon the position of the divider chosen by the user. Thus, the dividers 32 may slide along the rails 28 and engage the slots 30 so as to define between them a desired length for a particular piece of food product. The support flites 21 are positioned at the bottom of each rail 28. Food product that is too big for the length of the dividers set on one lane will be carried downstream by the conveyor belt 16 until the food product arrives at a lane that accepts its particular length.

The conveyor 22 carries the food product that fits between the dividers 32 up and over the top of the mechanism where the food product is then dropped into a plurality of bins (not shown) arranged according to size. In general, the dividers 32 are closer together at the input end of the conveyor 16 and become more spaced apart toward the output end. Thus, smaller sized product is sorted first. At the output end 17 is a wall 15 that the product slides against as it is moved by the conveyor 16. The friction provided by the wall 15 against the moving product tends to align the product lengthways so that it is properly oriented for the next operation, halving.

Figure 1:
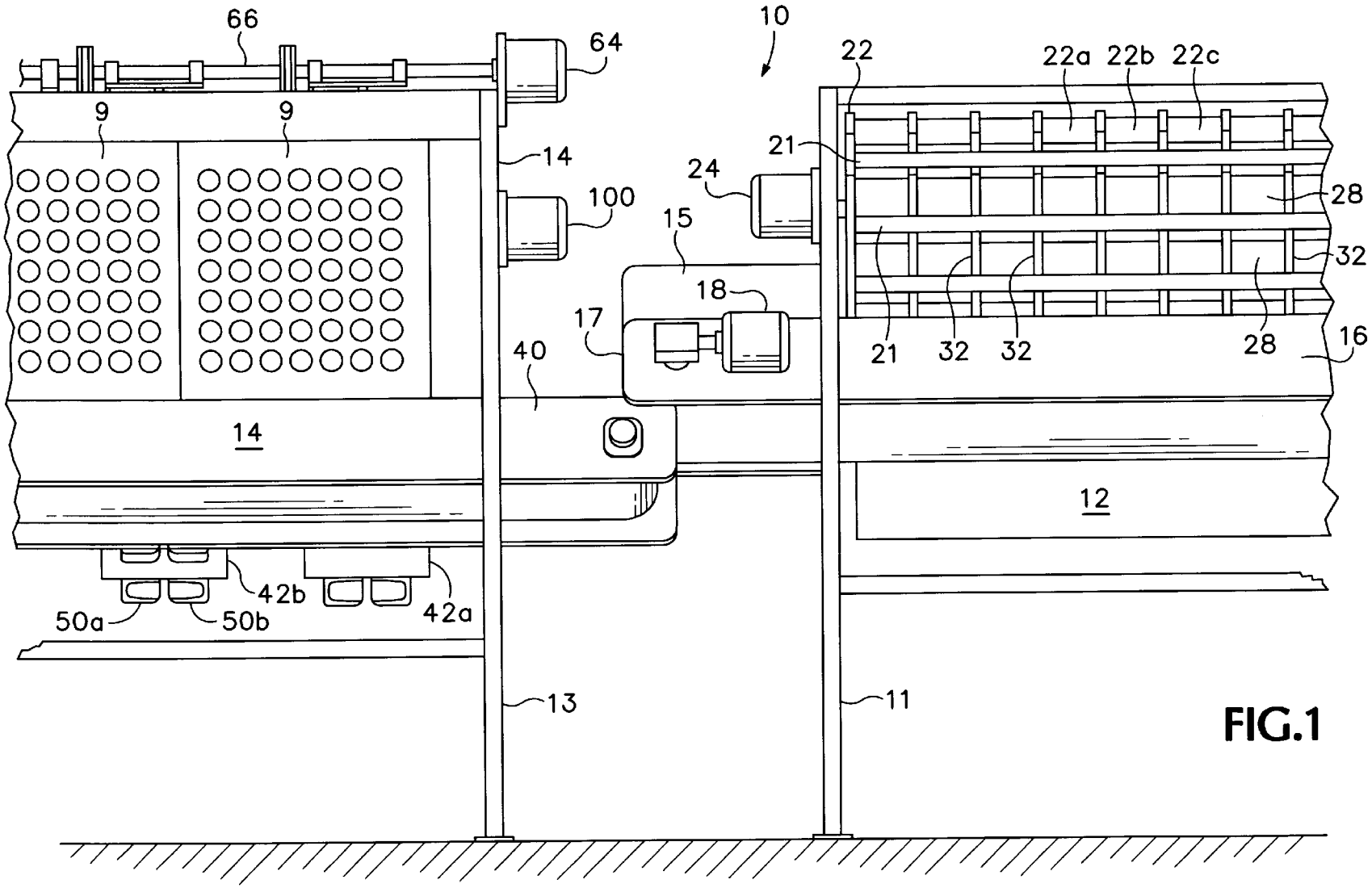
FIG. 1 is a partial front elevation view of the combination product sizer and halver of the present invention.
Figure 2:
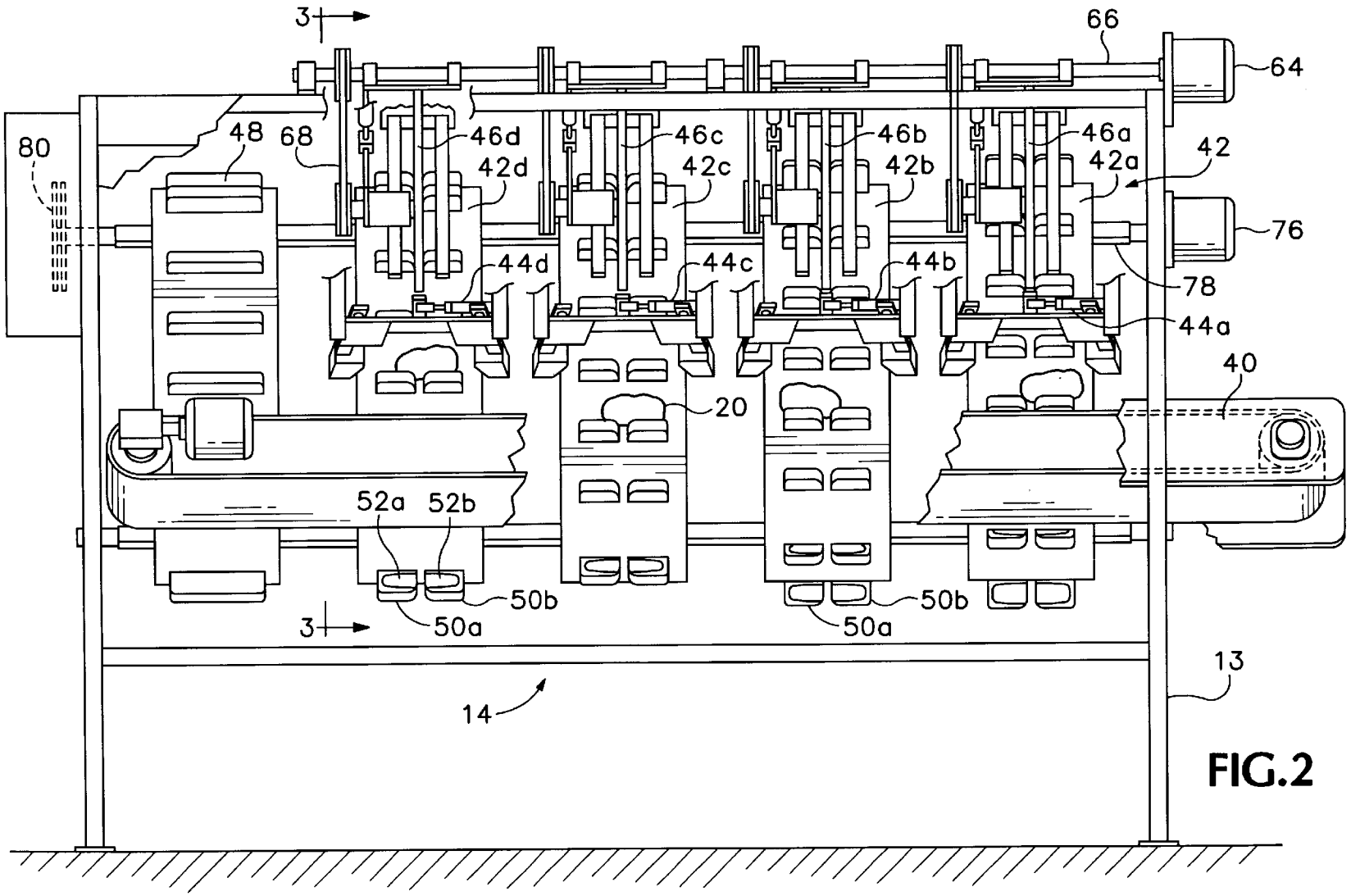
FIG. 2 is a front elevation view of the halver portion of the invention showing parts of the conveyor belt cut-away.

Referring once again to FIG. 1, product which is not accepted by the sizing mechanism (because it is too big) is dropped onto a second endless belt conveyor 40 at an output end 17 of the first belt conveyor 16. The second endless belt 40 transfers the oversized product to the halver portion 14 of the mechanism 16. Moving parts of the halver 14 may be enclosed in cages 9 for safety. As best shown in FIG. 2, the halver 14 includes a second vertical lift conveyor 42 which includes four lanes 42*a*, 42*b*, 42*c* and 42*d*. Each of the four lanes 42*a*, 42*b*, 42*c* and 42*d* of the vertical lift conveyor 42 include centering mechanisms 44*a* through 44*d* and cutting blade mechanisms 46*a* through 44*d*. At the end of the halver 14 farthest downstream along endless conveyor 40, a fifth conveyor lane 48 picks up the remaining oversized product from the conveyor belt 40 and deposits it in the appropriate bin (not shown).

The rest of the product processed by the halver is oversized product which will be cut in half. Thus, each of the lanes 42*a* through 42*d* includes on the respective conveyor belts pairs of flites such as flites 50*a* and 50*b* shown on vertical lift conveyor 42*c*. The flites 50*a* and 50*b* are arranged as side-by-side pairs separated by a narrow space. Each of the flites has a scalloped region 52*a* and 52*b* so that when the product tumbles from the conveyor belt 40 onto one of the lift conveyor flites, it comes to rest in a position that is suitable for the centering and cutting operations which are to follow. The scalloped portions 52*a* and 52*b* are oval depressions in the surfaces of the flites 50*a* and 50*b*.

Figure 3:
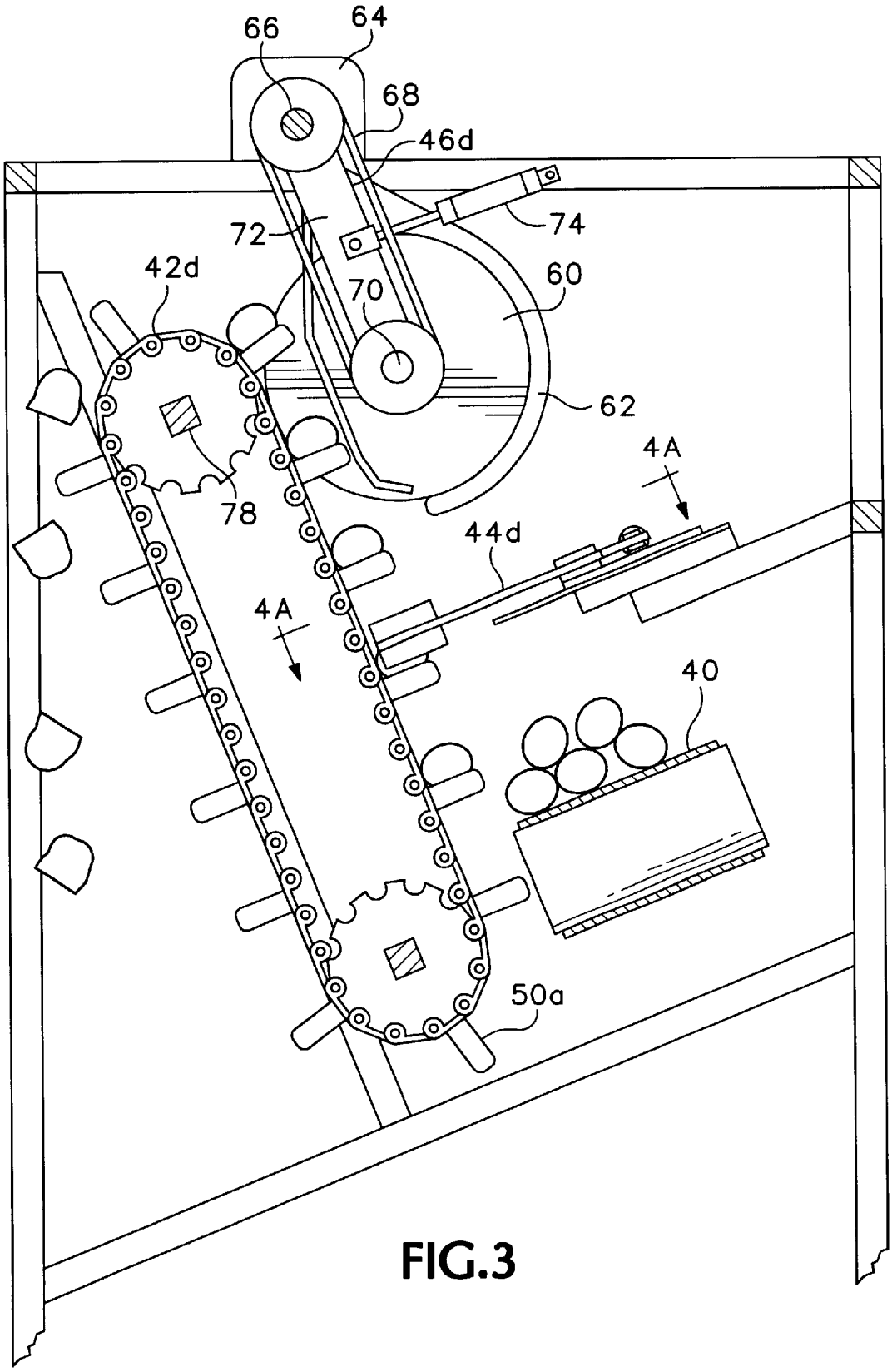
FIG. 3 is a cutaway end view taken along line 3—3 of FIG. 2.
Figure 4:
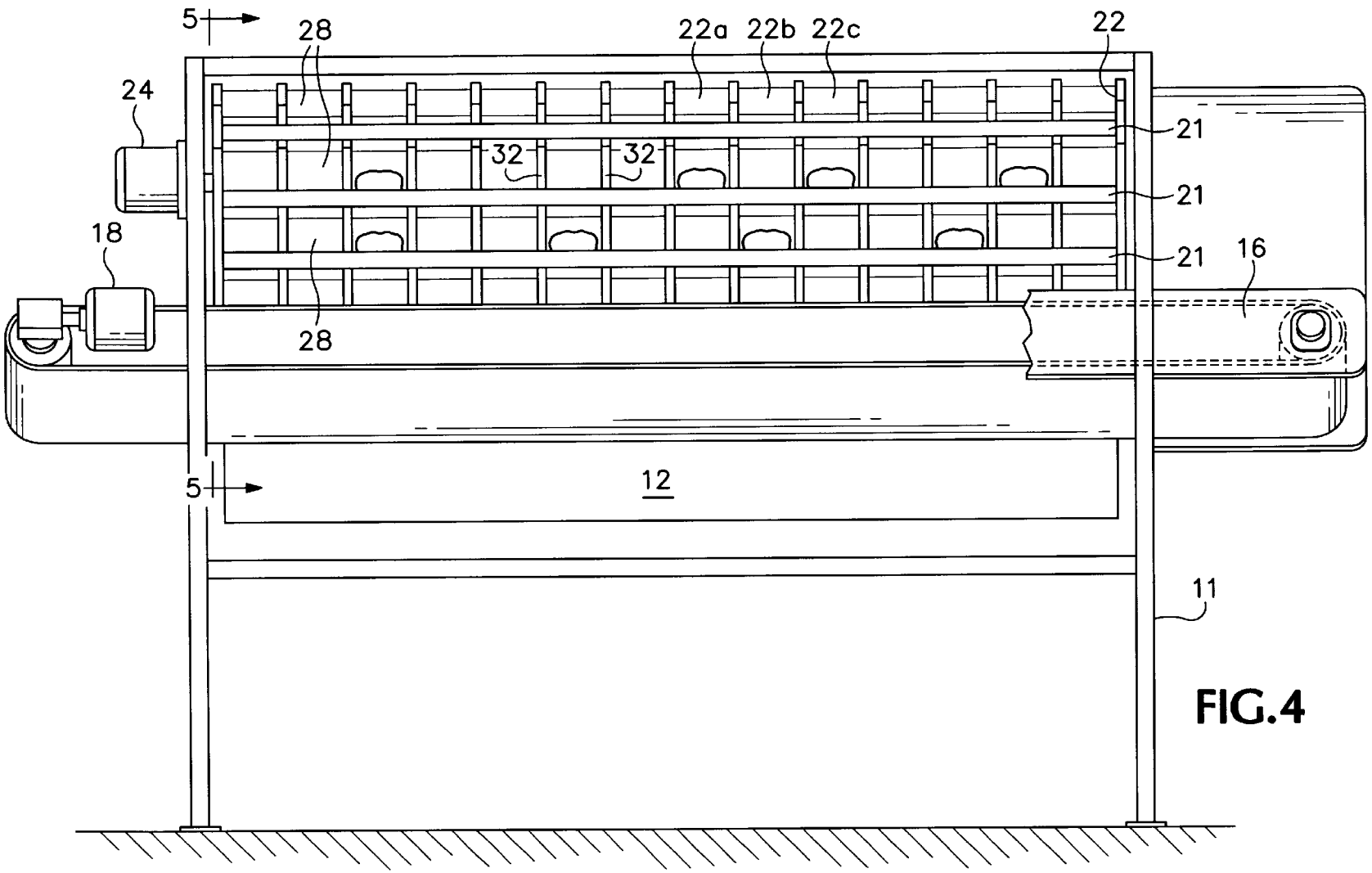
FIG. 4 is a front elevation view of the product sizing portion of the invention.

Referring to FIG. 3, each cutting blade mechanism such as mechanism 46*d* includes a blade 60 and a guard 62. The blade 60 is continuously spinning which is driven by a motor 64 (refer to FIG. 2) which, in turn, drives a shaft 66. A belt 68 causes the blade 60 to spin since it is mounted on a shaft 70 for free rotation. The blade 60 is supported by an arm 72 which is mounted to the shaft 66 by a bearing (not shown). The arm 72 permits the blade to flex slightly under the control of a biasing actuator 74. The actuator 74 is a pneumatic actuator but in practice a leaf spring or other biasing device could be substituted for the pneumatic actuator.

The vertical lift conveyor 42 is driven by a motor 76. The 76 turns a shaft 78 which has a square or rectangular cross section. At an end of the shaft 78 which is opposite from the motor 100, there is a timing wheel 80 which controls the timing of the centering mechanisms 44*a–d*. The timing wheel interacts with proximity sensors to control the clamping action of the centering mechanisms 44*a–d*.

There are fourteen pairs of flites on each of the four conveyor belt lanes 42*a* through 42*d*. As can be seen in FIG. 2, the flites (such as 50*a*, 50*b*) are slightly staggered in phase with respect to other flites on adjacent vertical conveyor belt lanes 42*a* through 42*d*. Viewing the apparatus from left to right, it can be observed that the flites are staggered so as to form an ascending staircase pattern. The teeth (not shown) on timing wheel 80 are arranged so that when a tooth is sensed by a proximity sensor, the resultant signal triggers a clamping cycle. Once the cycle has been triggered, all four of the clamping mechanisms 44*a* through 44*d* will be actuated by signals from the proximity sensor. These operations are staggered in time because it has been discovered that otherwise the noise from four sets of clamps operating all at once can exceed acceptable noise standards for processing plants of this type. In addition, staggered operation produces less wear because vibration is distributed more evenly.

The precise timing of the actuators in response to signals from the proximity sensors are controlled by a conventional Allen Bradley Model 1000 Programmable logic controller. Additionally, the controller may control the clamp actuators on clamping mechanisms 44*a* through 44*d* with respect to parameters including dwell time and force.

The resulting product recovered in the bins comprises properly sized potatoes or oversized potatoes which have been cut in half so as to fall within the length requirements of the customer. The system operates fully automatically and can accommodate product of variable size.

Figure 8:
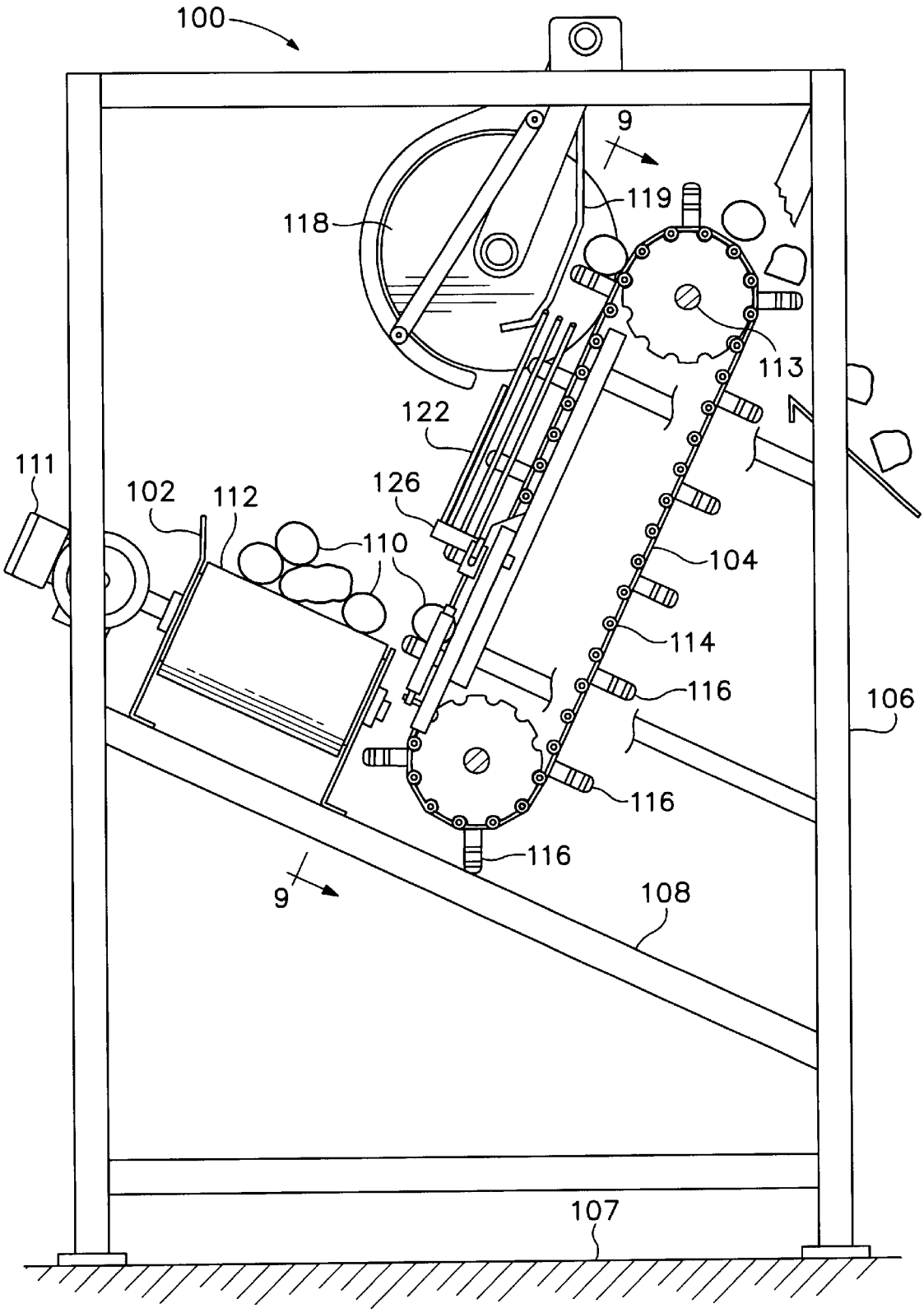
FIG. 8 is an elevation view of an alternative form of the halver apparatus employing a different type of centering device.
Figure 9:
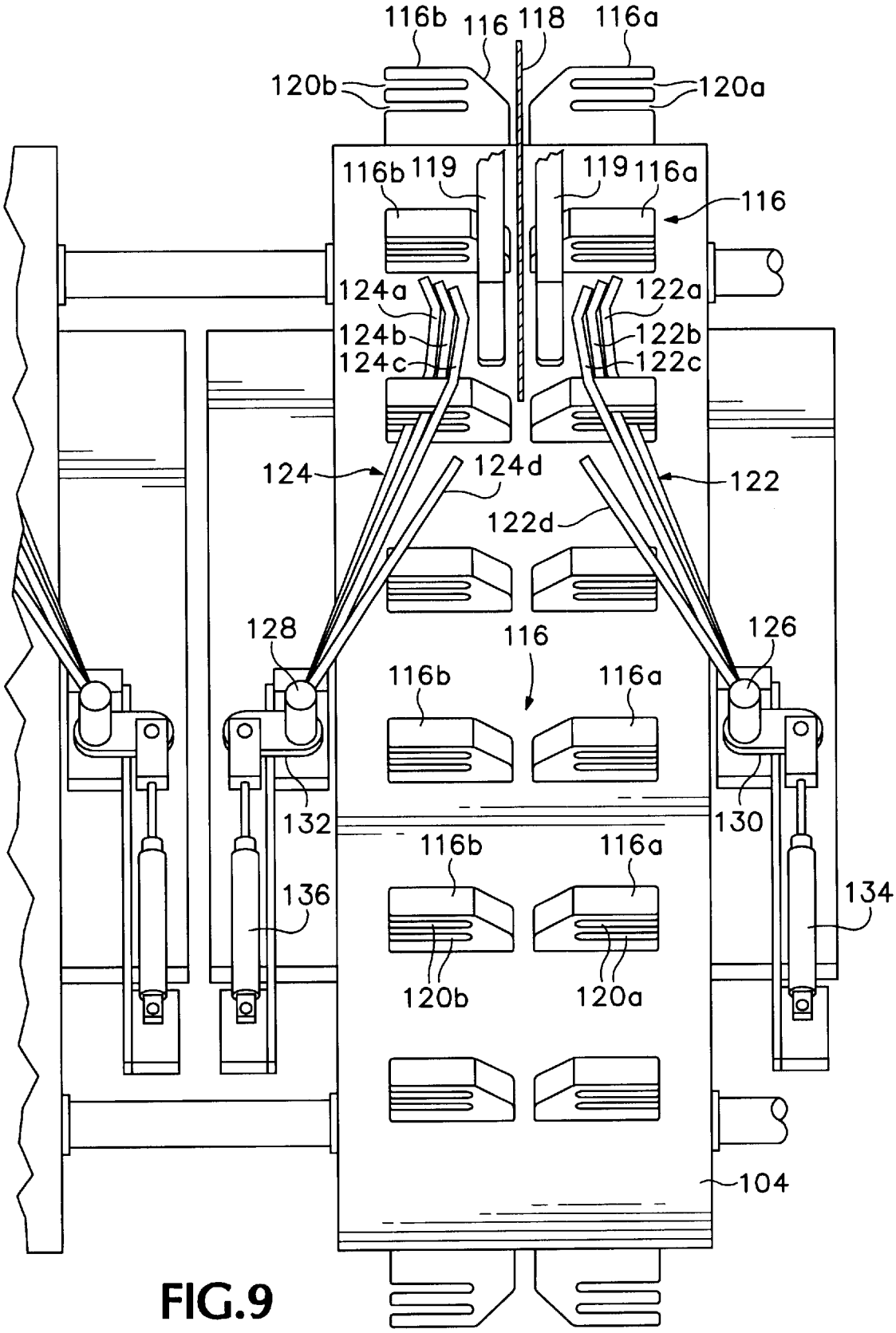
FIG. 9 is a partial front view of one lane of the halver apparatus taken along line 9—9 of FIG. 8.
Figure 10:
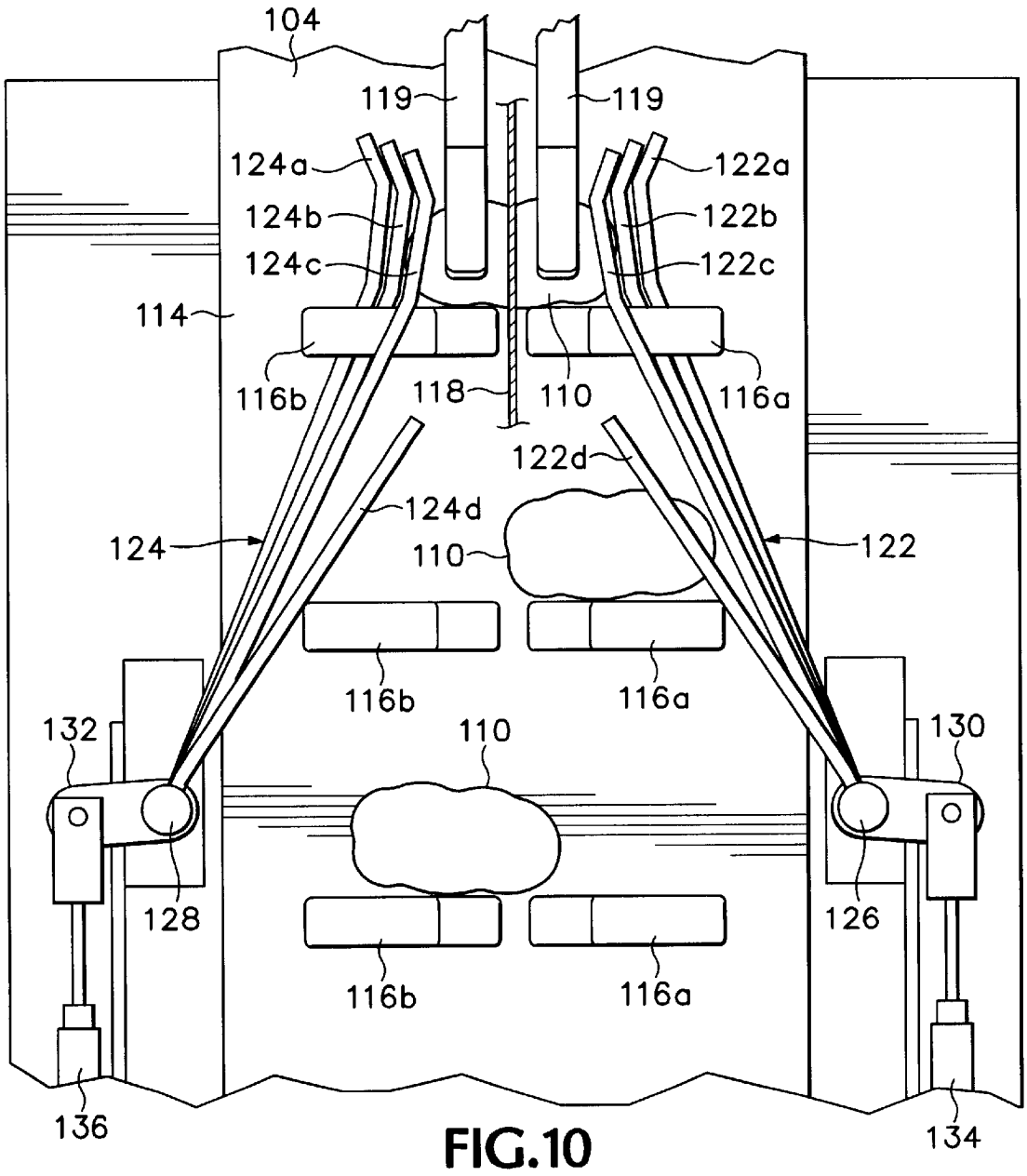
FIG. 10 is a partial front close-up view of one lane of the halver apparatus of FIG. 8.

An alternative version of the product halving mechanism of FIGS. 2–7 is shown in FIGS. 8, 9 and 10. In this embodiment of the invention, the food product is centered on respective flites of the lift conveyor by sets of spring-loaded rods which interact with each piece of the product deposited on a flite through slots in each pair of flite members. The rods are passive devices which are provided with a biasing force by an actuator such as an air spring. Thus, there is no timing mechanism required.

Referring to FIG. 8, an apparatus 100 for halving pieces of product comprises a loading conveyor 102 and a lift conveyor 104. Both the loading conveyor 102 and the lift conveyor 104 are mounted on a frame 106 which rests on a horizontal planar surface 107. The loading conveyor 102 is supported on a tilted frame member 108. The loading conveyor 102 carries individual pieces of product 110 in a direction along a longitudinal axis. That axis, in FIG. 8, is an axis normal to the plane of the page. The loading conveyor 102 has a moving planar surface 112 which may be of the endless belt type driven by a motor 111. The planar surface 112 is tilted with respect to the horizontal plane defined by surface 107. The tilting of the loading conveyor 102 and its associated moving planar surface 112 occurs about the aforementioned longitudinal axis and the degree of tilt is approximately 250.

Figure 11:
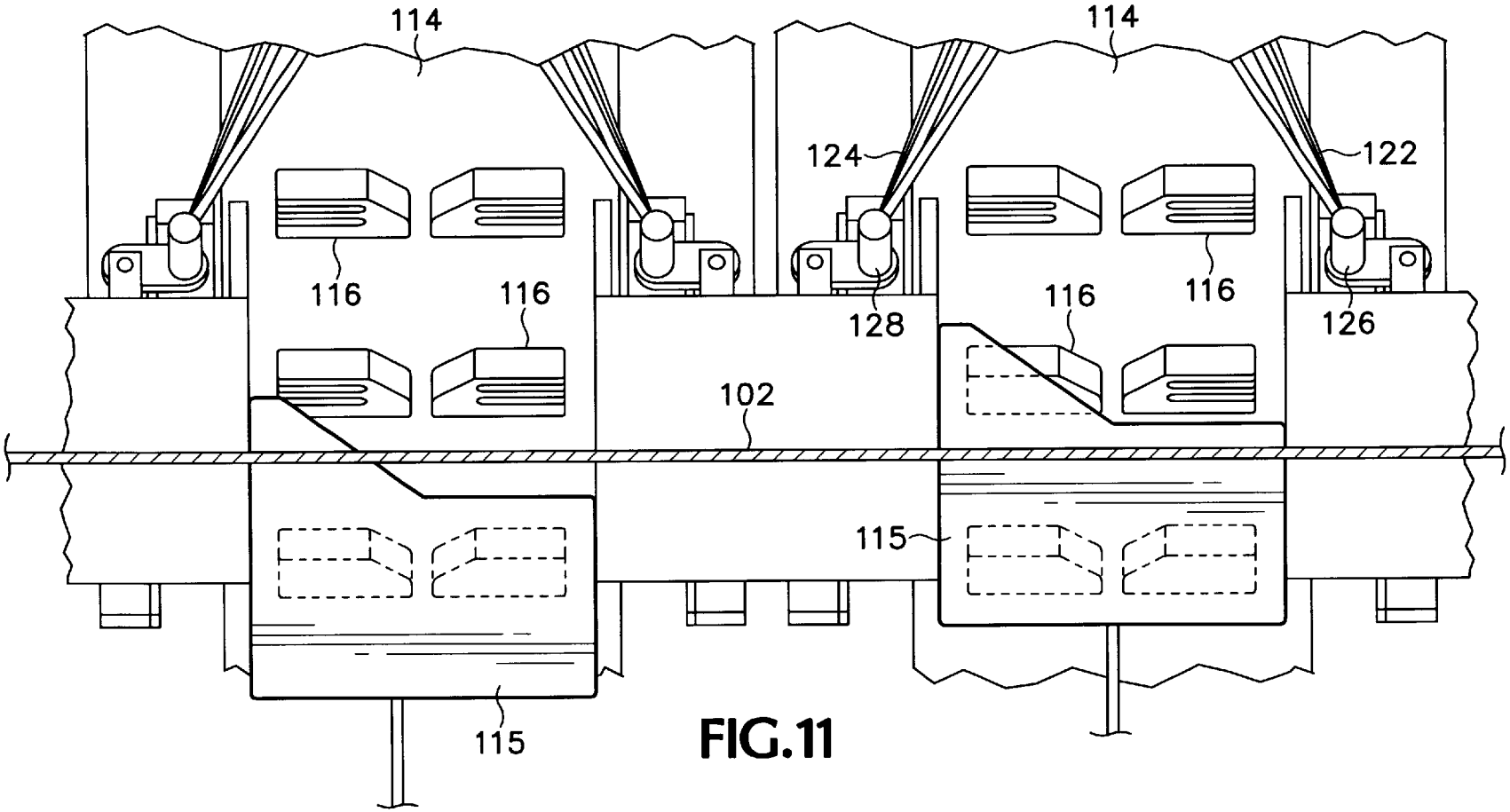
FIG. 11 is a partial front view of the halver apparatus of FIG. 8 illustrating multiple lanes with lane sizing gates.

The lift conveyor 104 comprises a moving surface 114 which may be of an articulated endless belt type draped over a drive shaft 113. There may be multiple lanes of the conveyor, each one having a belt like belt 114 (see FIG. 11) with associated sets of flites, centering fingers and a blade. The conveyor is driven on the rotating shaft 113 by a motor (not shown) whose speed can be made variable. Varying the speed of the lift conveyor 104 permits the user to maximize efficiency. When running higher capacities, the speed is increased to keep up with system demand.

Figure 12:
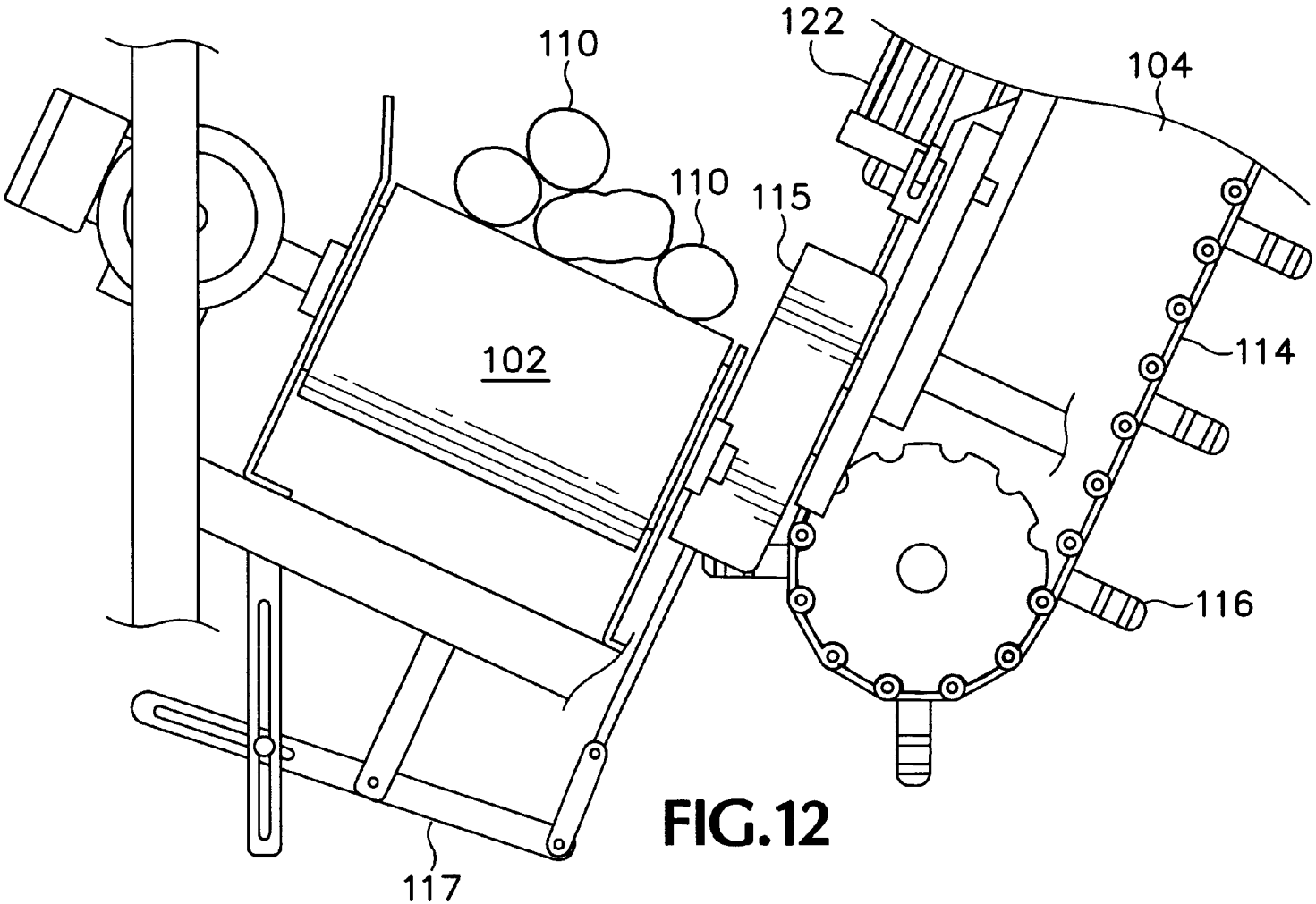
FIG. 12 is a partial side view of the apparatus of FIG. 8 showing the added provision of lane sizing gates.

The lift conveyor 104 is positioned adjacent to the loading conveyor 102 and is oriented in a plane that is parallel to the longitudinal axis of the loading conveyor. The loading conveyor is tilted at an angle of approximately 25 degrees to the horizontal plane. This particular angle is not critical, but has been found to work best in most circumstances. The lift conveyor 104 receives the pieces of product 110 from the loading conveyor 102 and conveys the product in an upward direction substantially at a right angle to the plane of the loading conveyor 102 as defined by planar surface 112. The loading conveyor includes a plurality of flites 116 which are spaced along the lift conveyor 104. Each flite 116 supports one piece of product 110 at a time. Each lane includes a lane sizing gate 115 in the form of a baffle interposed between its belt 114 and the loading conveyor 102. The gates 115 may be raised and lowered at the entrances to the several lanes of the lift conveyor as shown best in FIG. 11. Because each baffle has a slanted end portion, raising the baffle tends to make the lane entrance smaller, effectively limiting the size of product accepted by that lane. Conversely, lowering the baffle makes the lane entrance wider. The gates 115 are raised and lowered through the use of an adjustable linkage 117 (refer to FIG. 12).

The apparatus 100 further includes a cutting blade 118 which is positioned relative to the lift conveyor 104 for cutting each piece of product in half as it is carried upward by the flites 116. The blade 118 is, preferably, passive, that is, it is not driven. Its cutting action is caused by the pressure of the rising flites 116 which drive the centered product pieces directly into the blade 118. With different types of product, however, it may be better to have the blade driven as in the embodiment of FIGS. 2 and 3.

As best shown in FIG. 9, each flite 116 comprises a pair of flite members 116*a*, 116*b* positioned side-by-side in a spaced apart relation to allow the passage of the cutting blade 118 between them. The flite members 116*a*, 116*b* are tilted slightly toward the center which provides for better centering of product. In addition, the front corner of each flite member has a relieved portion that forms a v-shaped notch in the center between a pair of flite members. This notch allows misaligned product to fall back onto the loading conveyor. Each of the flite members 116*a*, 116*b* include lateral slots 120*a* and 120*b*. The slots 120*a* and 120*b* in each of the flite members 116*a* and 116*b* receive centering fingers in the form of oppositely opposed sets of rods 122 and 124. Each of the rod sets 122 and 124 comprise a plurality of angled rod members 122*a*, 122*b* and 122*c* and 124*a*, 124*b* and 124*c* respectively. Two of these rod members enter the slots 120*a* and 120*b* respectively on each side of a flite. The third rod member 122*c* and 124*c* extends across the front of each of the flite members 116*a*, 116*b*. The fourth rod in each set, 122*d* and 124*d* respectively, is spaced away from the front of the flites 116*a* and 116*b*, respectively, and serve as retainers to push misaligned pieces of product either back onto the flite members 116*a* and 116*b* where they will be subject to the centering action of the remaining rods, or if the product pieces 110 are severely misaligned, the rods 122*d* and 124*d* will reject these pieces entirely and cause them to fall back onto the conveyor 112.

The rod sets 122, 124 extend from respective pivotally mounted cylinders 126, 128 respectively. The pivoting cylinders 126, 128 are pivotally mounted on either side of the lift conveyor 104 to a portion of the frame 106 and are coupled to links 130, 132. Mounted at the opposite ends of each of the links 130, 132 are biasing force devices which provide a force component that urges the rod sets 124 and 122 to pivot inwards toward each other with a rotational moment transmitted to the cylinders 126, 128 respectively through the links 130, 132 respectively. In the preferred embodiment, the bias force devices are air cylinders 134 and 136 respectively. Other types of bias force producing devices could be used as well such as coil springs, leaf springs or other types of hydraulic or pneumatic devices.

Each lane also includes a pair of hold-down devices in the form of leaf springs or spring loaded strips 119 positioned on either side of the blade 118. These leaf springs bear against each piece of product as it is forced into the blade by the rising flites, holding it in place in a centered position on the flites while the blade 118 engages the product.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. An apparatus for halving pieces of product comprising:

a) a loading conveyor for conveying individual pieces of product in a direction along a longitudinal axis;

b) a lift conveyor positioned adjacent to the loading conveyor and oriented at substantially a right angle thereto for receiving pieces of product from the loading conveyor and for conveying pieces of product in an upward direction, the lift conveyor including a plurality of flites spaced along the lift conveyor, each flite supporting, one at a time, the pieces of product; and, c) centering fingers positioned adjacent the lift conveyor for simultaneously engaging the pieces of product from each side thereof as they are conveyed upward by the lift conveyor and for centering each piece of product on its respective flite wherein said fingers comprise a pair of pivotable rod sets positioned one on each side of the lift conveyor and coupled each through a pivot point to a respective force actuator whereby to bias the rod sets toward each other, said pivotable rod sets each comprising a plurality of rods and wherein said flites include slots for receiving selected ones of said plurality of rods; and, d) a cutting blade positioned to engage and cut each piece of product as it rises on the lift conveyor.

2. An apparatus for halving pieces of product comprising:

a) a loading conveyor for conveying individual pieces of product in a direction along a longitudinal axis;

b) a lift conveyor positioned adjacent to the loading conveyor and oriented at substantially a right angle thereto for receiving pieces of product from the loading conveyor and for conveying pieces of product in an upward direction, the lift conveyor including a plurality of flites spaced along the lift conveyor, each flute supporting, one at a time, the pieces of product; and, c) centering fingers positioned adjacent the lift conveyor for engaging the pieces of product as they are conveyed upward by the lift conveyor and for centering each piece of product on its respective flite wherein the centering fingers are force biased rods positioned on each side of the lift conveyor for urging said pieces of product toward the centers of said flites and wherein the flites comprise pairs of support ledges positioned side by side and further include lateral slots for receiving said force biased rods; and, d) a cutting blade positioned to engage and cut each piece of product as it rises on the lift conveyor.

3. An apparatus for halving pieces of product comprising:

a) a loading conveyor for conveying individual pieces of product in a direction along a longitudinal axis, said axis extending in a horizontal plane, the loading conveyor having a planar surface defining a plane tilted with respect to said horizontal plane about said longitudinal axis;

b) a lift conveyor comprising a moving planar surface positioned adjacent to the loading conveyor and oriented in a plane parallel to said longitudinal axis for receiving pieces of product from the loading conveyor and for conveying said pieces of product in an upward direction substantially at a right angle to the plane of said loading conveyor, the lift conveyor including a plurality of flutes spaced along the lift conveyor, each flite supporting, one at a time, the pieces of product, wherein each flite comprises a pair of flite members positioned side by side in spaced apart relation to allow the passage of said cutting blade therebetween, and at least one centering finger on each side of said lift conveyor for simultaneously engaging and centering each piece of product substantially evenly between each pair of flute members and wherein each pair of flute members include lateral slots said apparatus further including a plurality of centering fingers positioned on each side of said lift conveyor so as to extend into said slots to engage a piece of product supported on said flite member; and, c) a cutting blade positioned to engage each piece of product as it moves along the lift conveyor so as to cut each said piece of product into two pieces.

4. The apparatus of claim 3 wherein said plurality of centering fingers comprise spring loaded rods providing a force component urging each piece of product towards the center of the flute upon which said piece of product rests.

* * * * *

UNITED STATES PATENT AND TRADEMARK OFFICE

CERTIFICATE OF CORRECTION

PATENT NO. : 6,748,837 B2 
DATED : June 15, 2004
INVENTOR(S) : Scott R. Benjamin, John E. Mobley and Marc R. Olsen It is certified that error appears in the above-identified patent and that said Letters Patent is hereby corrected as shown below:

Column 4,
Line 2, "… 46a through 44d..." should read -- … 46a through 46d … --
Lines 31-32, "… The 76 turns …" should read -- … The motor 76 turns … --

Column 5,
Line 25, "… approximately 250." should read -- … approximately 25°. --

Column 6,
Line 36, "… moment transmitted …" should read -- … movement transmitted … --

Column 7,
Line 23, "… each flute …" should read -- … each flite … --

Column 8,
Line 15, "… plurality of flutes …" should read -- ...plurality of flites … --
Line 23, "… pair of flute members …" should read -- … pair of flite members … --
Line 24, "… flute members include …" should read -- … flite members include … --
Line 35, "… of the flute upon …" should read -- … of the flite upon … --

Signed and Sealed this

Nineteenth Day of July, 2005

JON W. DUDAS
*Director of the United States Patent and Trademark Office*